US005937252A

United States Patent [19]

Peters, Jr. et al.

[11] Patent Number: 5,937,252

[45] Date of Patent: Aug. 10, 1999

[54] TRICKLE PORT BETWEEN TWO AUGERS IN A DEVELOPER HOUSING

[75] Inventors: Henry B. Peters, Jr., Webster; Paul J. Rowe, Rochester; Steven C. Hart, Ontario; Daniel P. White, Honeoye Falls; Steven A. Foltz, Penfield; Peter L. Sylvester, Jr., East Rochester, all of N.Y.

[73] Assignee: Xerox Corporation, Stamford, Conn.

[21] Appl. No.: 09/003,697

[22] Filed: Jan. 7, 1998

[51] Int. Cl.[6] ..... G03G 15/08

[52] U.S. Cl. ..... 399/256; 399/257

[58] Field of Search ..... 399/222, 256, 399/254, 265, 279, 257; 222/DIG. 1

[56] References Cited

U.S. PATENT DOCUMENTS

| | | | |
|---|---|---|---|
| 3,664,299 | 5/1972 | Shaler et al. | 399/256 |
| 3,999,514 | 12/1976 | Abbott et al. | 399/256 |
| 4,056,076 | 11/1977 | Smith | 399/256 |
| 4,146,323 | 3/1979 | Forward et al. | 399/256 |
| 4,173,405 | 11/1979 | Swapceinski et al. | 399/256 |
| 4,274,362 | 6/1981 | Beck et al. | 399/256 |
| 4,478,512 | 10/1984 | Zoltner | 399/106 |
| 5,196,890 | 3/1993 | Nakayama et al. | 399/222 |
| 5,204,721 | 4/1993 | Sharpe | 399/256 |
| 5,294,968 | 3/1994 | Ueda et al. | 399/256 |
| 5,355,199 | 10/1994 | Bray | 399/256 |
| 5,510,883 | 4/1996 | Kimura et al. | 399/256 |
| 5,655,193 | 8/1997 | Fujishiro et al. | 399/256 |
| 5,659,859 | 8/1997 | Kikuta et al. | 399/256 |
| 5,722,002 | 2/1998 | Kikuta et al. | 399/256 X |
| 5,758,238 | 5/1998 | Mordenga et al. | 399/256 |

*Primary Examiner*—Susan S. Y. Lee
*Attorney, Agent, or Firm*—Lloyd F. Bean, II

[57] ABSTRACT

A development system which includes a dual auger assembly, mounted in a housing, for mixing developer materials in which a trickle port is between the dual auger assembly at an end of the housing which enables combining the cleaner waste toner and trickle waste in a single without the need of an additional auger.

8 Claims, 4 Drawing Sheets

TRICKLE PORT BETWEEN TWO AUGERS IN A DEVELOPER HOUSING

BACKGROUND

The invention relates generally to an electrophotographic printing machine and, more particularly, to a development system which includes a dual auger assembly, mounted in a housing, for mixing developer materials in which a trickle port is between the dual auger assembly at an end of the housing which enables combining the cleaner waste toner and trickle waste in a single container without the need of an additional auger.

Generally, an electrophotographic printing machine includes a photoconductive member which is charged to a substantially uniform potential to sensitive the surface thereof. The charged portion of the photoconductive member is exposed to a light image of an original document being reproduced. This records an electrostatic latent image on the photoconductive member corresponding to the informational areas contained within the original document. After the electrostatic latent image is formed on the photoconductive member, the image is developed by bringing a developer material into contact therewith. Generally, the developer material comprises toner particles adhering triboelectrically to carrier granules. The toner particles are attached to the latent image from the carrier granules to form a powder image on the photoconductive member which is subsequently transferred to a copy sheet. Finally, the copy sheet is heated to permanently affix the powder image thereto in image configuration.

As the toner particles are depleted from the developer material, it is necessary to dispense additional toner particles into the developer mixture. Then newly added toner is typically mixed in some manner with the denuded carrier particles and unused developer material. Various prior art devices have been devised to accomplish the mixing function. A preferred system for accomplishing the crossmixing function is the use of a dual auger system to transport the toner in two directions and achieve a toner interchange between augers. Dual auger systems are disclosed, for example, in the following prior art documents. U.S. Pat. No. 4,274,362 to Beck et al. discloses magnetic brush mixing augers made of twisted strips of aluminum sheet metal with smooth axial edges. In a developing unit, the auger members are located in the sump portion of a developing pan where they circulate, distribute and intermix dry toner. A dispensing system evenly distributes regular amounts of toner while the copier is operable.

U.S. Pat. No. 4,056,076 to Smith, assigned to Xerox Corporation, discloses a crossmixing system for mixing and charging multicomponent developer in a circulating development system of an electrostatographic processor. A pair of parallel passive crossmixers are used as mixing devices and a single active crossmixer is used as a blending (triboelectric charging) device.

U.S. Pat. No. 4,146,323 to Forward et al., assigned to Xerox Corporation, discloses an auger for a development system comprised of an elongated twisted strip of sheet metal with helically contoured edges. As toner is dispensed, fresh toner is added to the developer from a toner dispenser directly above a crossmixer to keep the toner concentration at a high level.

U.S. Pat. No. 4,478,512 to Zoltner, assigned to Xerox Corporation, discloses a developer system in which a pair of augers mix newly dispensed toner with denuded carrier particles and returns the mixture into a developer sump.

U.S. Pat. No. 3,999,514 to Abbott et al. describes a supply and return auger system in which the augers are rotated at different flute and pitch related speeds which ensure equal flow through the auger.

U.S. Pat. No. 3,664,299 to Shaler et al. discloses still another dual auger mixing system.

These prior art patents described above are representative of the dual auger crossmixing type of system. The common characteristic of these systems is that the axis of each auger pair lie essentially in the same horizontal plane with developer exchange between each auger taking place at end locations. A problem with this inter-auger transfer is that the developer is exchanged by a sideways pushing application which requires that the augers be physically close to each other. For some systems, this proximity requirement may present a space or geometry problem. A second difficulty with this "push" inter-auger transfer is the tendency for the developer to "bunch up" at the transfer end, sometimes resulting in toner spilling over into other areas of the developer housing unless specific seals are placed at strategic locations.

The invariability, unpredictability and stability problems of developer flow in the becomes more acute in a trickle type developer system when it is desired to add a constant flow of new carrier material into the developer material while maintaining a constant flow of old developer material out of the housing. This is particularly difficult when the exit port for the developer material is located at one end of the housing to enable the use of a single waste bottle for cleaner waste and tickle waste.

The present invention is, therefore, directed to a dual auger crossmixing system which accomplishes. More particularly, the invention is directed toward a development system including a developer roll adapted for depositing developer material on an imaging surface having an electrostatic latent image thereon. A dual auger system is provided for mixing the developer material and transferring mixed developer material to the developer roll. The dual auger system includes a first and a second auger, the first auger is rotatably mounted between two end walls of the housing. The first auger has a plurality of blades is attached thereon. A second auger is rotatably mounted between the two end walls of the housing. The second auger has a plurality of blades is attached thereon, and second auger is adjacent to the first auger. An exit aperture is defined in one of the two end walls of the housing. The exit aperture is positioned between the first and second auger; and wherein the plurality of blades of the first auger and the plurality of blades of the second auger being positioned so that developer material flows out from the exit aperture to a waste container at a constant flow rate when the first and second augers rotate.

DESCRIPTION OF THE INVENTION

Figure 1:
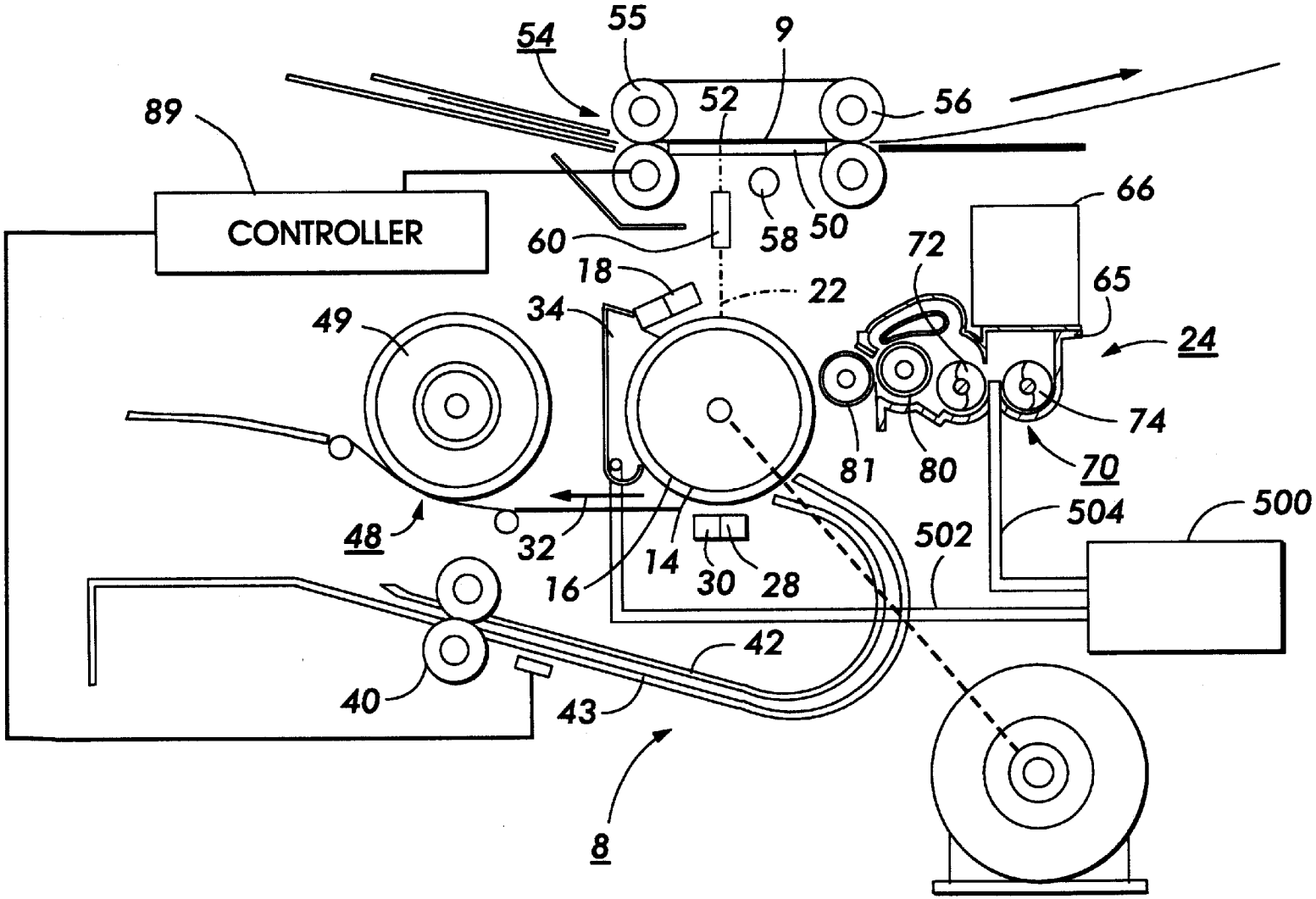
FIG. 1 is a side view, is section, of a xerographic reproduction machine incorporating the dual auger mixing assembly of the present invention.

Referring to FIG. 1 of the drawings, there is shown a xerographic type reproduction machine 8 incorporating the dual auger mixing assembly of the present invention, designated generally by the numeral 10. Machine 8 has a suitable frame (not shown) on which the machine xerographic components are operatively supported. Briefly, and as will be familiar to those skilled in the art, the machine xerographic components include a recording member, shown here in the form of a rotatable photoreceptor 14. In the exemplary arrangement shown, photoreceptor 14 comprises a drum having a photoconductive surface 16. Operatively disposed about the periphery of photoreceptor 14 are a charge corotron 18 for placing a uniform charge on the photoconductive surface 16 of photoreceptor 14; an exposure station 22 where the previously charged photoconductive surface 16 is exposed to image rays of a document 9 being copied or reproduced; development station 24 where the latent electrostatic image created on photoconductive surface 16 is developed by toner; and transfer detack corotrons 28 and 30 for assisting transfer of the developed image to a suitable copy substrate material such as a copy sheet 32 brought forward in timed relation with the developed image on photoconductive surface 16. Residual toner is removed from the drum surface at cleaning station 34 and is deposited in waste container 500 via waste tube 502.

Copy sheets 32 are brought forward to the transfer area by feed roll pair 40, sheet guides 42, 43 serving to guide the sheet through an approximately 180° turn prior to the transfer area. Following transfer, the sheet 32 is carried forward to a fusing station 48 where the toner image is fixed by fusing roll 49. After fusing, the copy sheet 32 is discharged to an output tray.

A transparent platen 50 supports the document 9 as the document is moved past a scan point 52 by a constant velocity type transport 54. As will be understood, scan point 52 is in effect a scan line extending across the width of platen 50 at a desired point along the platen where the document is scanned line by line as the document is moved along platen 50 by transport 54. Transport 54 has input and output document feed roll pairs 55, 56, respectively, on each side of scan point 52 for moving document 9 across platen 50 at a predetermined speed. Exposure lamp 58 is provided to illuminate a strip-like area of platen 50 at scan point 52. The image rays from the document line scanned are transmitted by a gradient index fiber lens array 60 to exposure station 22 to expose the photoconductive surface 16 of the moving photoreceptor 14.

Developer station 24 includes a developer housing 65 in which a toner dispensing cartridge 66 is rotatably mounted so as to dispense toner particles and developer material downward into a sump area occupied by the dual auger mixing assembly 70 of the present invention. Assembly 70 includes a pair of rotatably mounted augers 72, 74; further details of the construction and operation of assembly 70 are provided below.

Continuing with the description of the developing station 24, a magnetic brush developer roll 80 is disposed in predetermined operative relation to the photoconductive surface 16 of photoreceptor 14, the length of developing roll 80 being equal to or slightly greater than the width of photoconductive surface 16, with the axis of roll 80 parallel to the axis of photoreceptor 14. Developer roll 80 has a plurality of stationary magnet assemblies 81 disposed within a rotatable cylinder or sleeve 75, sleeve 75 being rotatably journaled for rotation in the opposing sides of developer housing 65. Magnet assemblies 81 are arranged so that as sleeve 75 rotates, developer is attracted to the exterior surface of sleeve 75 to form a brush-like layer 82 on sleeve 75. Rotation of sleeve 75 carries the developer brush 82 into developing relation with the photoconductive surface 16 of photoreceptor 14 to develop the latent electrostatic image therein.

A suitable controller 89 is provided for operating the various components of machine 8 in predetermined relation with one another to produce copies. In operation, machine 8 is actuated by a suitable start control button. The document to be copied is then inserted into the nip of document transport roll pair 55, 56 which carries the document across platen 50. As the leading edge of the document reaches a detector, controller 89, in response to the signal from the detector, starts feed roll pair 40 to advance the copy sheet 32 forward in timed relation with the document 9 as the document is transported across platen 50 and past scan point 52 by document transport 54. The document image developed on the photoconductive surface 16 of photoreceptor 14 is transferred to copy sheet 32 as the copy sheet moves through the transfer area. Following transfer, the copy sheet 32 passes to fusing station 48 where the image is fixed.

As latent images are formed, and developer and toner depleted, fresh toner is dispensed as dispenser cartridge 66 rotates. Auger 72 continually mixes the fresh toner with the denuded carrier particles and existing developer. As the auger 72 rotates in a counterclockwise direction, and with arcuate segments 104 having an orientation as shown, the mixture is conveyed from right to left in FIG. 4 and into the page in FIG. 5. The mixture then transfers into the auger 74 system, which carries the developer uphill to the retransfer point. The system is thus constantly ensuring that freshly added toner is constantly being mixed into the existing developer.

Figure 2:
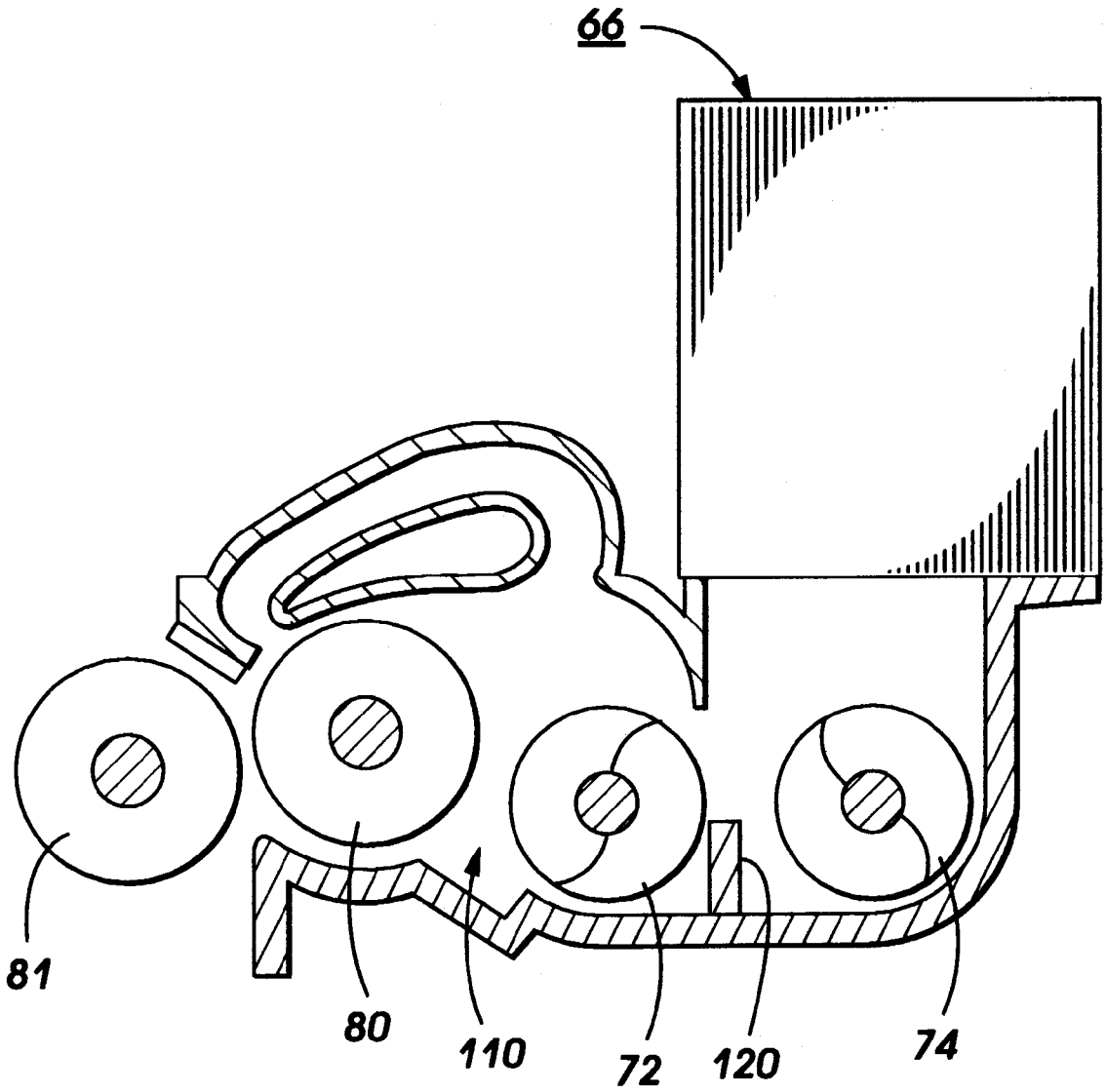
FIG. 2 is an enlarged side view of the developer assembly shown in FIG. 1.
Figure 3:
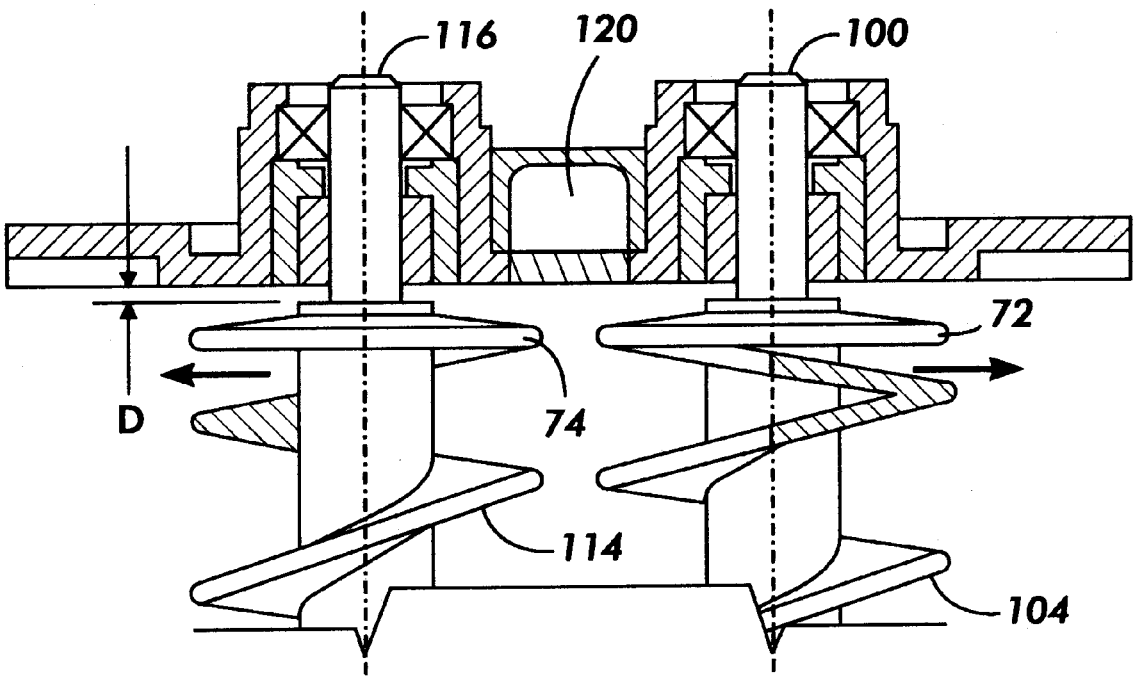
FIG. 3 is an enlarged top view of the developer assembly shown in FIG. 2.
Figure 4:
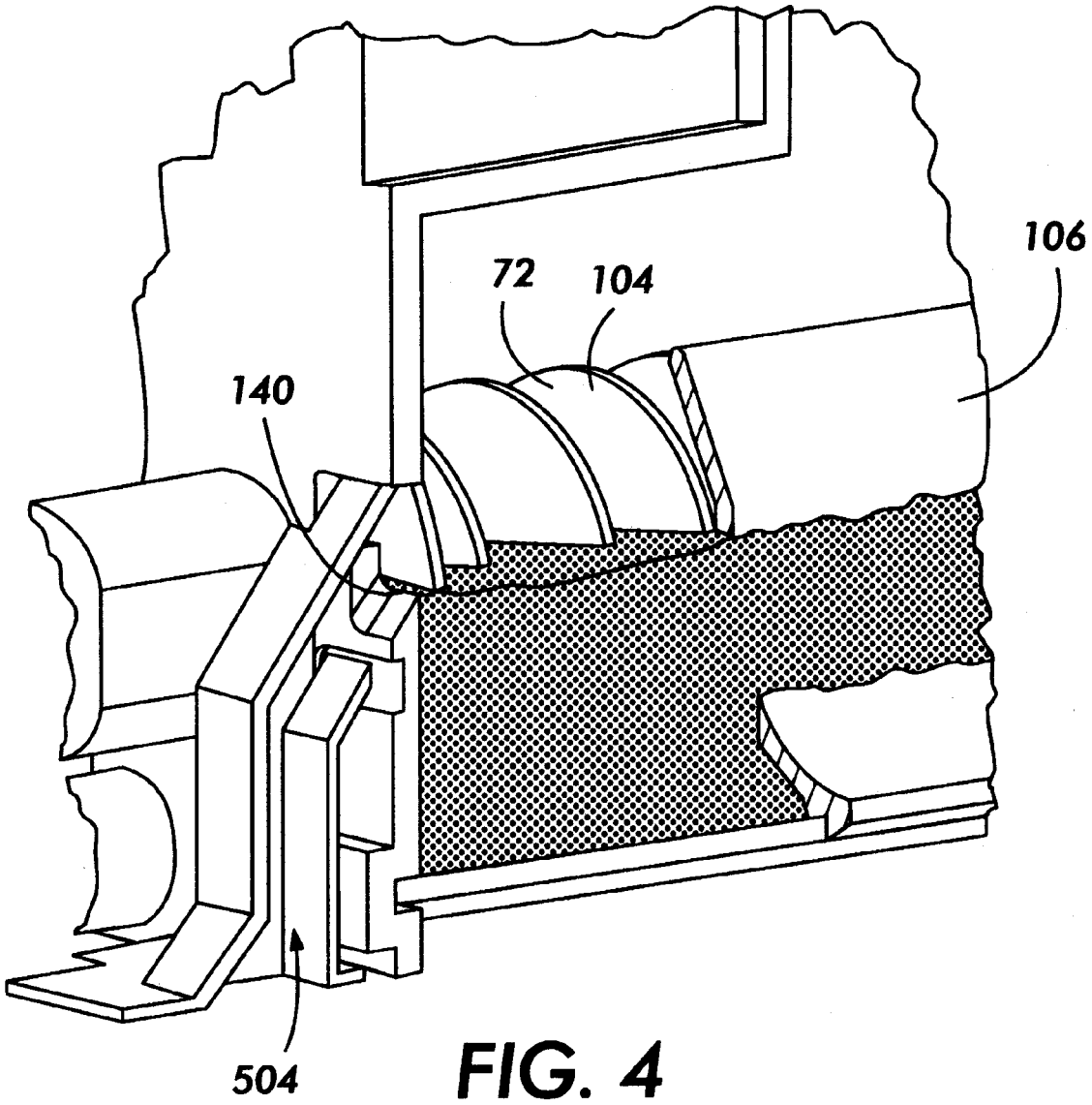
FIG. 4 is a partial side view of the developer assembly shown in FIG. 1.

Turning now to a more detailed description of the developer station 24, and particularly the auger mixing assembly 70, FIGS. 2 and 3 show an end view and top view of the developer assembly. FIG. 4 shows the toner transfer between auger from a top and side view perspective, respectively. Auger 72 having arcuate segments 104 is mounted on horizontal shaft 100 which is driven by motor means (not shown) in a counterclockwise direction. Supported beneath auger 72 is a trough 106 extending the length of the auger. Supported above auger 72 is pickoff baffle portion of trough having a series of ports (not shown) extending therethrough permitting toner from housing 66 to be dispensed through the ports in a steady flow downward into the mixing assembly area sump 110 where it is then picked up by the exterior surface of sleeve 75 to form the toner brush. Auger 74, having arcuate segments 114, is mounted on shaft 116 and driven by appropriate motor means in a clockwise direction. The developer is transferred from auger 72 to auger 74 by gravitational force acting on the toner. Auger 74 then mixes the developer. The developer then falls into sump 110 or is again picked up by auger 72. The trickle port 504 is located between two augers on the end of a developer housing and the combining of the cleaner waste with the trickle waste in a single container. This system dumps both the developer material (trickle waste) and toner from the cleaner into one common easy to replace bottle. In order to maintain a constant trickle flow out of the housing and maintain the required developer sump level, the position and geometry of the exit port in the end wall and the location and orientation of the developer housing augers must be as described below. Without unpredictable and unstable i.e. the developer housing sump mass is highly variable. The developer trickle port 504 has been located to accommodate both exiting excess developer from the housing and removing toner from the cleaner into a tube 503 and empty into a common waste bottle 500. It has been found that exiting developer from the side plate of the housing had posed a problem of maintaining a constant developer sump weight/level. Trickle port locations between two rotating augers had historically been avoided due to the inherent instability of sump mass as observed in early experiments. By proper phasing/tuning of the two auger system the flow patterns of the developer housing material stabilized to maintain a consistent level across the housing. This has been accomplished by tolerancing of the auger end spacing and proper orientation (angular phase relationship) of the flights on the augers during installation. As a result, a constant flow level is maintained across the opening 120 of the trickle port 504. The auger segments 100 and 114 set to be 180 degrees wherein the tolerance can be ±12°. The auger spacing of the first segment of the augers to the side plate is between 4.51 to 1.16 mm.

While the invention has been described with reference to the structure disclosed, it is not confined to the specific details set forth, but is intended to cover such modifications or changes as may come within the scope of the following claims.

What is claimed is:

1. In a development system including a housing, a developer roll mounted in said housing, for depositing developer material on an imaging surface having an electrostatic latent image thereon, a dual auger system, for mixing said developer material and; transferring mixed developer to said developer roll, said dual auger system comprising a first auger, rotatably mounted between two end walls of said housing, said first auger having a set of a plurality of blades;

a second auger, rotatably mounted between said two end walls of said housing, and adjacent to said first auger, said second auger having a set of a plurality of blades;

an exit aperture defined in one of said two end walls of said housing, said exit aperture being positioned between said first and second auger; and wherein set of said plurality of blades of said first auger and set of said plurality of blades of said second auger being in positioned in said housing so that developer material flows out from said exit aperture at a constant flow rate when said first and second augers rotate.

2. The development system of claim 1, wherein said set of said plurality of blades of first auger is positioned 180 degrees out of phase with said set of said plurality of blades of said second auger.

3. The development system of claim 1, wherein a first blade immediately adjacent to said end wall of said set of said plurality of blades of said first auger is positioned between 4.51 mm to 1.16 mm from said end wall of said housing.

4. The development system of claim 3, wherein a first blade immediately adjacent to said end wall of said set of said plurality of blades of said second auger is positioned between 4.51 mm to 1.16 mm from said end wall of said housing.

5. A printing machine, comprising:

means for recording a latent image on an imaging surface;

a development system for depositing developer material on an imaging surface having said latent image thereon, said development system including a housing, a developer roll mounted in said housing, a first and a second auger for mixing said developer material and transferring mixed developer to said developer roll, said first auger, rotatably mounted between two end walls of said housing, said first auger having a set of a plurality of blades, a second auger, rotatably mounted between said two end walls of said housing, said second auger having a set of a plurality of blades, adjacent to said first auger, an exit aperture defined in one of said two end walls of said housing, said exit aperture being positioned between said first and second auger; and wherein said set of said plurality of blades of said first auger and said set of said plurality of blades of said second auger being positioned so that developer material flows out from said exit aperture to a waste container at a constant flow rate when said first and second augers rotate.

6. The development system of claim 5, wherein said set of said plurality of blades of first auger is positioned 180 degrees out of phase with said set of said plurality of blades of said second auger.

7. The development system of claim 6, wherein a first blade immediately adjacent to said end wall of said set of said plurality of blades of said first auger is positioned between 4.51 mm to 1.16 mm from said end wall of said housing.

8. The development system of claim 7, wherein a first blade immediately adjacent to said end wall of said set of said plurality of blades of said second auger is positioned between 4.51 mm to 1.16 mm from said end wall of said housing.

* * * * *